US011001788B2

(12) United States Patent
Holderbaum

(10) Patent No.: US 11,001,788 B2
(45) Date of Patent: May 11, 2021

(54) CONTINUOUS METHOD FOR PRODUCING PERFUME-CONTAINING MELTING BODIES

(71) Applicant: Henkel AG & Co. KGaA, Duesseldorf (DE)

(72) Inventor: Thomas Holderbaum, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 16/364,689

(22) Filed: Mar. 26, 2019

(65) Prior Publication Data

US 2019/0218480 A1 Jul. 18, 2019

Related U.S. Application Data

(63) Continuation of application No. PCT/EP2017/074105, filed on Sep. 22, 2017.

(30) Foreign Application Priority Data

Sep. 26, 2016 (DE) ..... 10 2016 218 483.0
Oct. 5, 2016 (DE) ..... 10 2016 219 295.7

(51) Int. Cl.

| | |
|---|---|
| ***C11D 17/00*** | (2006.01) |
| ***C11D 3/50*** | (2006.01) |
| ***C11D 3/37*** | (2006.01) |
| ***C11D 11/00*** | (2006.01) |
| ***C11D 3/00*** | (2006.01) |

(52) U.S. Cl.

CPC ..... *C11D 3/505* (2013.01); *C11D 3/001* (2013.01); *C11D 3/3707* (2013.01); *C11D 3/50* (2013.01); *C11D 3/507* (2013.01); *C11D 11/0082* (2013.01)

(58) Field of Classification Search

CPC ..... C11D 3/3707; C11D 3/505; C11D 3/2068; C11D 3/50; C11D 17/0052; C11D 11/0082; C11D 17/044

See application file for complete search history.

(56) References Cited

U.S. PATENT DOCUMENTS 7,867,968 B1 * 1/2011 Aouad ..... C11D 17/04 510/296
2012/0270765 A1 10/2012 Aouad
2016/0089464 A1 * 3/2016 Frankenbach ..... A61K 8/31 424/76.1

FOREIGN PATENT DOCUMENTS

DE 102007037147 A1 2/2009

OTHER PUBLICATIONS

CTFA International Cosmetic Ingredient Dictionary, Fourth Edition. Edited by Joanne M. Nikitakis et al., The Cosmetic, Toiletry, and Fragrance Association, Washington D.C., 1991, 23 pages.
PCT International Search Report PCT/EP2017/074105 Completed Date: Nov. 20, 2017; dated Dec. 12, 2017 2 pages.

* cited by examiner

*Primary Examiner* — John R Hardee
(74) *Attorney, Agent, or Firm* — Bojuan Deng

(57) ABSTRACT

Disclosed is a continuous method for producing perfume-containing melting bodies which include at least one water-soluble or water-dispersible carrier polymer having a melting point>30° C. to 250° C. and at least one aromatic substance. The method contains the following steps: continuous supply, optionally continuous production and supply, of a melt having the at least one water-soluble or water-dispersible carrier polymer; continuous addition of the at least one aromatic substance to the melt-having the at least one water-soluble or water-dispersible carrier polymer; mixing the melt having the at least one water-soluble or water-dispersible carrier polymer and the at least one aromatic substance; and cooling the mixture in order to produce perfume-containing melting bodies. Also disclosed is perfume-containing melting bodies produced in this way.

20 Claims, No Drawings

CONTINUOUS METHOD FOR PRODUCING PERFUME-CONTAINING MELTING BODIES

FIELD OF THE INVENTION

The present invention relates to a continuous method for the preparation of perfume-containing melt bodies comprising at least one water-soluble or water-dispersible carrier polymer having a melting point of >30° C. and at least one fragrance, the method comprising the method steps described herein and the perfume-containing melt bodies prepared in this way.

BACKGROUND OF THE INVENTION

When using washing and cleaning agents, the consumer not only aims to wash, clean or care for the objects to be treated, but also wishes that after treatment, for example after washing, the treated objects, such as textiles, have a pleasant smell. For this reason, in particular, most commercially available washing and cleaning agents contain fragrances.

Fragrances are often used in the form of fragrance particles, either as an integral component of a washing or cleaning agent, or dosed into the washing drum right at the beginning of a wash cycle in a separate form. In this way, the consumer can control the fragrance of the laundry to be washed by individual dosage.

Fragrance particles of this kind are usually provided in the form of perfume-containing melt bodies in batch processes. Such perfume-containing shaped bodies made from melts require the perfume to be exposed to higher temperatures during production. The finished product melt is then transferred by cooling into a shaped body. Any production disturbances mean that the melt has to stay at higher temperatures for a longer time. This may lead to the degradation of thermolabile components, such as some perfume components. In addition, the melting of the ingredients of the shaped body including the perfume already means that said perfume is exposed to unnecessarily long high temperatures, which may also be disadvantageous for the reasons mentioned above.

BRIEF SUMMARY OF THE INVENTION

The object of the present invention was therefore to overcome the above-mentioned problems in the preparation of perfume-containing melt bodies.

The object was achieved according to the invention by a continuous method in which the fragrances are fed continuously to a melt of one or more components of the shaped body, i.e. usually the at least one carrier polymer.

Of particular advantage is a continuous method in which firstly one or more components of the shaped body, i.e. usually the at least one carrier polymer, is melted and the fragrances are fed continuously to the melt.

In a first aspect, the present invention is therefore directed to a continuous method for the preparation of perfume-containing melt bodies comprising at least one water-soluble or water-dispersible carrier polymer having a melting point of >30° C. to 250° C., preferably >40° C. to 150° C., preferably selected from polyalkylene glycols, particularly preferably polyethylene glycol, and at least one fragrance, characterized in that the method comprises the steps of:

(a) continuously conveying, optionally continuously producing and conveying, a melt comprising the at least one water-soluble or water-dispersible carrier polymer;

(b) continuously feeding the at least one fragrance to the melt comprising the at least one water-soluble or water-dispersible carrier polymer;

(c) mixing the melt comprising the at least one water-soluble or water-dispersible carrier polymer and the at least one fragrance; and (d) cooling and optionally shaping the mixture to obtain perfume-containing melt bodies.

In particular, this aspect of the present invention therefore relates to a continuous method for the preparation of perfume-containing melt bodies comprising at least one water-soluble or water-dispersible carrier polymer having a melting point of >30° C. to 250° C., preferably >40° C. to 150° C., preferably selected from polyalkylene glycols, particularly preferably polyethylene glycol, and at least one fragrance, characterized in that the method comprises the steps of:

(a) continuously producing and conveying a melt comprising the at least one water-soluble or water-dispersible carrier polymer;

(b) continuously feeding the at least one fragrance to the melt comprising the at least one water-soluble or water-dispersible carrier polymer;

(c) mixing the melt comprising the at least one water-soluble or water-dispersible carrier polymer and the at least one fragrance; and (d) cooling and optionally shaping the mixture to obtain perfume-containing melt bodies.

"Melt" means a composition which can be conveyed, pumped and is flowable.

The melt comprising the at least one water-soluble or water-dispersible carrier polymer that is continuously conveyed according to the present invention, can be produced so as to be spatially decoupled from the conveyance.

In a further aspect, the present invention is directed to the perfume-containing melt bodies obtained in this way and to the use thereof as textile care agents, preferably fragrancing agents and/or softeners, for fragrancing and/or conditioning textile fabrics, or as an additive in a washing or cleaning agent.

These and other aspects, features, and advantages of the invention will become apparent to a person skilled in the art through the study of the following detailed description and claims. Any feature from one aspect of the invention can be used in any other aspect of the invention. Furthermore, it will readily be understood that the examples contained herein are intended to describe and illustrate but not to limit the invention and that, in particular, the invention is not limited to these examples.

Unless indicated otherwise, all percentages are indicated in terms of wt. %. Numerical ranges that are indicated in the format "from x to y" also include the stated values. If several preferred numerical ranges are indicated in this format, it is self-evident that all ranges that result from the combination of the various endpoints are also included. "At least one," as used herein, refers to 1 or more, for example 1, 2, 3, 4, 5, 6, 7, 8, 9 or more. In particular, this expression refers to the type of agent/compound and not to the absolute number of molecules. "At least one fragrance," therefore, means that at least one type of fragrance is included but also that 2 or more different types of fragrances may be contained.

DETAILED DESCRIPTION OF THE INVENTION

A first subject of the present invention is a continuous method for the preparation of perfume-containing melt bodies comprising at least one water-soluble or water-dispersible carrier polymer having a melting point of >30° C. to 250° C., preferably >40° C. to 150° C., preferably selected from polyalkylene glycols, particularly preferably polyethylene glycol, and at least one fragrance, characterized in that the method comprises the steps of:

(a) continuously conveying, optionally continuously producing and conveying, a melt comprising the at least one water-soluble or water-dispersible carrier polymer;
(b) continuously feeding the at least one fragrance to the melt comprising the at least one water-soluble or water-dispersible carrier polymer;
(c) mixing the melt comprising the at least one water-soluble or water-dispersible carrier polymer and the at least one fragrance; and
(d) cooling and optionally shaping the mixture to obtain perfume-containing melt bodies.

The melt bodies obtained are solid at room temperature and at temperatures of up to 30° C., preferably up to 40° C. The main component of the melt or shaped bodies prepared according to the methods described herein, these two terms being used interchangeably herein, is at least one water-soluble or water-dispersible carrier polymer. In various embodiments, the at least one carrier polymer is characterized in that it has a melting point of from 48° C. to 120° C., preferably 48° C. to 80° C. "Water-soluble" as used herein means a solubility in water at 20° C. of at least 1 g/L, preferably at least 10 g/L, more preferably at least 50 g/L. "Water-dispersible" as used herein means that the carrier polymer can be dispersed in water at a temperature of 20° C. using known methods.

According to the present invention, the at least one carrier polymer is preferably selected from polyalkylene glycols.

In the context of the present invention, suitable polyalkylene glycols are those having an average molecular weight of >1,000 g/mol, in particular >1,500 g/mol, preferably an average molecular weight of between 3,000 and 15,000, more preferably having an average molecular weight of between 4,000 and 13,000, and particularly preferably an average molecular weight of between 9,000 and 12,000.

If, in the context of this application, the term "average molecular weight of polyalkylene glycols" is used, this information relates in each case to the values calculated from the OH number measured in accordance with DIN 53240.

According to the present invention, particularly suitable polyalkyl glycols are those which have a melting point between 40° C. and 90° C., in particular in the range of from 45 to 70° C. Examples of polyalkylene glycols that are suitable in the context of the present invention are polypropylene glycol and polyethylene glycol.

According to some embodiments, the at least one carrier polymer is preferably polyethylene glycol.

In some embodiments, the at least one carrier polymer is a polyethylene glycol having an average molecular weight of >1,500 g/mol, preferably an average molecular weight of between 3,000 and 15,000, more preferably having an average molecular weight of between 4,000 and 13,000, and particularly preferably having an average molecular weight of between 6,000 and 8,000 or 9,000 to 12,000. In some embodiments, a polyethylene glycol of this kind is characterized by a melting point in the range of from 45 to 70° C., preferably 50 to 65° C., more preferably 50 to 60° C.

In various embodiments, the at least one carrier polymer is contained in the melt body in an amount of from 30 to 95 wt. %, preferably from 35 to 85 wt. %, for example 40 to 80 or 40 to 78 wt. %, based on the total weight of the melt body.

Another component of the melt body is at least one fragrance. A fragrance is a chemical substance that stimulates the sense of smell. In order to stimulate the sense of smell, it should be possible to at least partially redistribute the chemical substance in the air, i.e. the fragrance should be volatile at 25° C. at least to a small extent. If the fragrance is very volatile, the odor intensity abates quickly. At a lower volatility, however, the smell is more lasting, i.e. it does not disappear as quickly. In one embodiment, the fragrance therefore has a melting point in the range of from −100° C. to 100° C., preferably from −80° C. to 80° C., more preferably from −20° C. to 50° C., in particular from −30° C. to 20° C. In one embodiment, the fragrance therefore has a boiling point in the range of from 25° C. to 400° C., preferably from 50° C. to 380° C., more preferably from 75° C. to 350° C., in particular from 100° C. to 330° C.

Overall, in order to act as a fragrance, a chemical substance should not exceed a certain molecular weight since, if molecular weight is too high, the required volatility can no longer be ensured. In one embodiment, the fragrance has a molecular weight of from 40 to 700 g/mol, more preferably from 60 to 400 g/mol.

The odor of a fragrance is perceived by most people as pleasant and often corresponds to the smell of, for example, flowers, fruits, spices, bark, resin, leaves, grasses, mosses and roots. Fragrances can thus also be used to overlay unpleasant odors or even to provide a non-smelling substance with a desired odor. It is possible, for example, to use individual odorant compounds, such as synthetic products of the ester, ether, aldehyde, ketone, alcohol and hydrocarbon types, as fragrances.

Fragrance compounds of the aldehyde type are, for example, adoxal (2,6,10-trimethyl-9-undecenal), anisaldehyde (4-methoxybenzaldehyde), cymene (3-(4-isopropylphenyl)-2-methylpropanal), ethylvanillin, Florhydral (3-(3-isopropylphenyl)butanal), helional (3-(3,4-methylenedioxyphenyl)-2-methylpropanal), heliotropin, hydroxycitronellal, lauraldehyde, Lyral (3- and 4-(4-hydroxy-4-methylpentyl)-3-cyclohexene-1-carboxaldehyde), methylnonylacetaldehyde, Lilial (3-(4-tert-butylphenyl)-2-methylpropanal), phenylacetaldehyde, undecylenealdehyde, vanillin, 2,6,10-trimethyl-9-undecenal, 3-dodecene-1-al, alpha-n-amylcinnamaldehyde, Melonal (2,6-dimethyl-5-heptenal), 2,4-dimethyl-3-cyclohexene-1-carboxaldehyde (Triplal), 4-methoxybenzaldehyde, benzaldehyde, 3-(4-tert-butylphenyl)-propanal, 2-methyl-3-(para-methoxyphenyl) propanal, 2-methyl-4-(2,6,6-timethyl-2(1)-cyclohexene-1-yl)butanal, 3-phenyl-2-propenal, cis-/trans-3,7-dimethyl-2,6-octadiene-1-al, 3,7-dimethyl-6-octene-1-al, [(3,7-dimethyl-6-octenyl)oxy] acetaldehyde, 4-isopropylbenzylaldehyde, 1,2,3,4,5,6,7,8-octahydro-8,8-dimethyl-2-naphthaldehyde, 2,4-dimethyl-3-cyclohexene-1-carboxaldehyde, 2-methyl-3-(isopropylphenyl)propanal, 1-decanal, 2,6-dimethyl-5-heptenal, 4-(tricyclo[5.2.1.0(2,6)]-decylidene-8)-butanal, octahydro-4,7-methane-1H-indenecarboxaldehyde, 3-ethoxy-4-hydroxybenzaldehyde, para-ethyl-alpha, alpha-dimethylhydrocinnamaldehyde, alpha-methyl-3,4-(methylenedioxy)-hydrocinnamaldehyde, 3,4-methylenedioxybenzaldehyde, alpha-n-hexylcinnamaldehyde, m-cymene-7-carboxaldehyde, alpha-methylphenylacetaldehyde, 7-hydroxy-3,7-dimethyloctanal, undecenal, 2,4,6-trimethyl-3-cyclohexene-1-carboxaldehyde, 4-(3)(4-methyl-3-pentenyl)-3-cyclohexene carboxaldehyde, 1-dodecanal, 2,4-dimethylcyclohexene-3-carboxaldehyde, 4-(4-hydroxy-4-methylpentyl)-3-cyclohexene-1-carboxaldehyde, 7-methoxy-3,7-dimethyloctane-1-al, 2-methyl-undecanal, 2-methyldecanal, 1-nonanal, 1-octanal, 2,6,10-trimethyl-5, 9-undecadienal, 2-methyl-3-(4-tert-butyl)propanal, dihydrocinnamaldehyde, 1-methyl 4-(4-methyl-3-pentenyl)-3-cyclohexene-1-carboxaldehyde, 5- or 6-methoxyhexahydro-4,7-methanindane-1- or 2-carboxaldehyde, 3,7-dimethyloctane-1-al, 1-undecanal, 10-undecene-1-al, 4-hydroxy-3-methoxybenzaldehyde, 1-methyl-3-(4-methylpentyl)-3-cyclohexenecarboxaldehyde, 7-hydroxy-3J-dimethyl-octanal, trans 4-decenal, 2,6-nonadienal, para-tolylacetaldehyde, 4-methylphenylacetaldehyde, 2-methyl-4-(2,6,6-trimethyl-1-cyclohexene-1-yl)-2-butenal, ortho-methoxycinnamaldehyde, 3,5,6-trimethyl-3-cyclohexenecarboxaldehyde, 3J-dimethyl-2-methylene-6-octenal, phenoxyacetaldehyde, 5,9-dimethyl-4,8-decadienal, peonyaldehyde (6,10-dimethyl-3-oxa-5,9-undecadiene-1-al), hexahydro-4,7-methanindane-1-carboxaldehyde, 2-methyloctanal, alpha-methyl-4-(1-methylethyl)benzene-acetaldehyde, 6,6-dimethyl-2-norpinen-2-propionaldehyde, para-methylphenoxyacetaldehyde, 2-methyl-3-phenyl-2-propene-1-al, 3,5,5-trimethylhexanal, hexahydro-8,8-dimethyl-2-naphthaldehyde, 3-propyl-bicyclo[2.2.1]-hept-5-ene-2-carbaldehyde, 9-decenal, 3-methyl-5-phenyl-1-pentanal, methylnonylacetaldehyde, hexanal and trans-2-hexenal.

Fragrance compounds of the ketone type are, for example, methyl-beta-naphthyl ketone, musk indanone (1,2,3,5,6,7-hexahydro-1,1,2,3,3-pentamethyl-4H-inden-4-one), Tonalid (6-acetyl-1,1,2,4,4,7-hexamethyltetralin), alpha-damascone, beta-damascone, delta-damascone, iso-damascone, damascenone, methyldihydrojasmonate, menthone, carvone, camphor, Koavone (3,4,5,6,6-pentamethylhept-3-en-2-one), fenchone, alpha-ionone, beta-ionone, gamma-methyl-ionone, fleuramone (2-heptylcyclopentanone), dihydrojasmone, cis-jasmone, Iso-E-Super (1-(1,2,3,4,5,6J,8-octahydro-2,3,8,8-tetramethyl-2-naphthalenyl)-ethane-1-one (and isomers)), methyl cedrenyl ketone, acetophenone, methyl acetophenone, para-methoxy acetophenone, methyl beta-naphthyl ketone, benzyl acetone, benzophenone, para-hydroxyphenyl butanone, celery ketone (3-methyl-5-propyl-2-cyclohexenone), 6-isopropyldecahydro-2-naphthone, dimethyloctenone, frescomenthe (2-butane-2-yl-cyclohexane-1-one), 4-(1-ethoxyvinyl)-3,3,5,5-tetramethylcyclohexanone, methylheptenone, 2-(2-(4-methyl)-3-cyclohexen-1-yl)propyl)cyclopentanone, 1-(p-menthene-6(2)-yl)-1-propanone, 4-(4-hydroxy-3-methoxyphenyl)-2-butanone, 2-acetyl-3,3-dimethylnorbornane, 6,7-dihydro-1,1,2,3,3-pentamethyl-4(5H)-indanone, 4-damascol, Dulcinyl(4-(1,3-benzodioxol-5-yl)butane 2-one), hexalone (1-(2,6,6-trimethyl-2-cyclohexene-1-yl)-1,6-heptadien-3-one), Isocyclemone E (2-acetonaphthone-1,2,3,4,5,6,7,8-octahydro-2,3,8,8-tetramethyl), methyl nonylketone, methylcyclocitrone, methyl lavender ketone, Orivone (4-tert-amylcyclohexanone), 4-tert-butylcyclohexanone, delphone (2-pentyl-cyclopentanone), muscone (CAS 541-91-3), neobutenone (1-(5,5-dimethyl-1-cyclohexenyl)pent-4-en-1one), plicatone (CAS 41724-19-0), veloutone (2,2,5-trimethyl-5-pentylcyclopentane-1-one), 2,4,4,7-tetramethyl-oct-6-en-3-one and tetramerane (6,10-dimethylundecene-2-one).

Fragrance compounds of the alcohol type are, for example, 10-undecen-1-ol, 2,6-dimethylheptane-2-ol, 2-methylbutanol, 2-methylpentanol, 2-phenoxyethanol, 2-phenylpropanol, 2-tert-butycyclohexanol, 3,5,5-trimethylcyclohexanol, 3-hexanol, 3-methyl-5-phenyl-pentanol, 3-octanol, 3-phenyl-propanol, 4-heptenol, 4-isopropylcyclohexanol, 4-tert-butycyclohexanol, 6,8-dimethyl-2-nonanol, 6-nonen-1-ol, 9-decen-1-ol, α-methylbenzyl alcohol, α-terpineol, amyl salicylate, benzyl alcohol, benzyl salicylate, β-terpineol, butyl salicylate, citronellol, cyclohexyl salicylate, decanol, di-hydromyrcenol, dimethylbenzylcarbinol, dimethylheptanol, dimethyloctanol, ethylsalicylate, ethylvaniline, eugenol, farnesol, geraniol, heptanol, hexylsalicylate, isoborneol, isoeugenol, isopulegol, linalool, menthol, myrtenol, n-hexanol, nerol, nonanol, octanol, p-menthane-7-ol, phenylethyl alcohol, phenol, phenyl salicylate, tetrahydrogeraniol, tetrahydrolinalool, thymol, trans-2-cis-6-nonadienol, trans-2-nonen-1-ol, trans-2-octenol, undecanol, vanillin, champiniol, hexenol and cinnamyl alcohol.

Fragrance compounds of the ester type are, for example, benzyl acetate, phenoxyethyl isobutyrate, p-tert-butylcyclohexyl acetate, linalyl acetate, dimethylbenzylcarbinyl acetate (DMBCA), phenylethyl acetate, benzyl acetate, ethylmethylphenyl glycinate, allylcyclohexyl propionate, styrallyl propionate, benzyl salicylate, cyclohexyl salicylate, floramate, melusate, and jasmecyclate.

Ethers include, for example, benzyl ethyl ether and Ambroxan. Hydrocarbons mainly include terpenes such as limonene and pinene.

Preferably, mixtures of different fragrances are used, which together produce an appealing fragrance note. Such a mixture of fragrances may also be referred to as perfume or perfume oil. Perfume oils of this kind may also contain natural fragrance mixtures, such as those obtainable from plant sources.

Fragrances of plant origin include essential oils such as angelica root oil, aniseed oil, arnica blossom oil, basil oil, bay oil, champaca blossom oil, citrus oil, abies alba oil, abies alba cone oil, elemi oil, eucalyptus oil, fennel oil, pine needle oil, galbanum oil, geranium oil, ginger grass oil, guaiac wood oil, gurjun balsam oil, helichrysum oil, ho oil, ginger oil, iris oil, jasmine oil, cajeput oil, calamus oil, chamomile oil, camphor oil, cananga oil, cardamom oil, cassia oil, pine needle oil, copaiba balsam oil, coriander oil, spearmint oil, caraway oil, cumin oil, labdanum oil, lavender oil, lemon grass oil, lime blossom oil, lime oil, mandarin oil, melissa oil, mint oil, musk seed oil, myrrh oil, clove oil, neroli oil, niaouli oil, olibanum oil, orange blossom oil, orange peel oil, oregano oil, palmarosa oil, patchouli oil, balsam Peru oil, petitgrain oil, pepper oil, peppermint oil, allspice oil, pine oil, rose oil, rosemary oil, sage oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil, and ambrettolide, Ambroxan, alpha-amylcinnamaldehyde, anethole, anisaldehyde, anise alcohol, anisole, anthranilic acid methyl ester, acetophenone, benzylacetone, benzaldehyde, benzoic acid ethyl ester, benzophenone, benzyl alcohol, benzyl acetate, benzyl benzoate, benzyl formate, benzyl valerianate, borneol, bornyl acetate, boisambrene forte, alpha-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptyne carboxylic acid methyl ester, heptaldehyde, hydroquinone dimethyl ether, hydroxycinnamaldehyde, hydroxycinnamyl alcohol, indole, irone, isoeugenol, isoeugenol methyl ether, isosafrole, jasmine, camphor, carvacrol, carvone, p-cresol methyl ether, coumarin, p-methoxyacetophenone, methyl n-amyl ketone, methylanthranilic acid methyl ester, p-methylacetophenone, methylchavicol, p-methylquinoline, methyl beta-naphthyl ketone, methyl n-nonylacetaldehyde, methyl n-nonyl ketone, muscone, beta-naphthol ethyl ether, beta-naphthol methyl ether, nerol, n-nonylaldehyde, nonyl alcohol, n-octylaldehyde, p-oxy-acetophenone, pentadecanolide, beta-phenethyl alcohol, phenylacetic acid, pulegone, safrole, salicylic acid isoamyl ester, salicylic acid methyl ester, salicylic acid hexyl ester, salicylic acid cyclohexyl ester, santalol, skatole, terpineol, thyme, thymol, gamma-undecalactone, vanillin, veratraldehyde, cinnamaldehyde, cinnamyl alcohol, cinnamic acid, cinnamic acid ethyl ester, cinnamic acid benzyl ester, diphenyl oxide, limonene, linalool, linalyl acetate and propionate, melusate, menthol, menthone, methyl-n-heptenone, pinene, phenylacetaldehyde, terpinyl acetate, citral, citronellal and mixtures thereof.

In an alternative embodiment, it may be preferable for at least some of the fragrance to be used as a fragrance precursor or in encapsulated form (fragrance capsules), in particular in microcapsules. The microcapsules may be water-soluble and/or water-insoluble microcapsules. For example, melamine-urea-formaldehyde microcapsules, melamine-formaldehyde microcapsules, urea-formaldehyde microcapsules or starch microcapsules may be used. "Fragrance precursor" refers to compounds that release the actual fragrance only after chemical conversion/cleavage, typically by exposure to light or other environmental conditions such as pH, temperature, etc. Such compounds are often also referred to as fragrance storage substances or "pro-fragrances."

Irrespective of the form in which they are used, the amount of fragrance in the melt bodies is preferably between 1 and 20 wt. %, preferably 1 to 15 wt. % and in particular from 3 to 10 wt. %, based on the total weight of the composition.

In various embodiments, the perfume-containing melt body as described herein may also comprise at least one textile care compound. In this context, a textile care compound is understood to mean any compound which gives textile fabrics treated therewith an advantageous effect, such as a textile softening effect, crease resistance or that of reducing the harmful or negative effects which may result during cleaning and/or conditioning and/or wearing, such as fading, graying, etc.

The textile care composition may preferably be selected from textile-softening compounds, bleaching agents, bleach activators, enzymes, silicone oils, anti-redeposition agents, optical brighteners, graying inhibitors, shrinkage preventers, anti-crease agents, dye transfer inhibitors, antimicrobial active ingredients, germicides, fungicides, antioxidants, antistatic agents, ironing aids, repellants, impregnating agents, anti-swelling and anti-slip agents, UV absorbers and mixtures thereof.

Particularly preferably, the textile care compound is a textile-softening compound. Very particularly preferably, the textile-softening compound is selected from polysiloxanes, textile-softening clays, cationic polymers and mixtures thereof.

The use of polysiloxanes and/or cationic polymers as a textile-care compound in the melt bodies is advantageous because they not only exhibit a softening effect, but also enhance the perfume impression on the laundry. The use of softening clays as a textile-care compound in the composition is advantageous because they additionally have a water-softening effect and thus, for example, limescale on the laundry can be prevented. To achieve optimum performance, it may be preferable for a melt body to contain a combination of at least two textile care compounds.

If the melt bodies prepared according to the invention contain textile care compounds of this kind, said bodies are used in particular as textile care agents or softeners or as a component of an agent of this kind or as components of a washing agent.

A softener of this kind may be used in the main wash cycle of an automatic washing or cleaning process. The composition can be added, for example, together with the washing or cleaning agent in the drum or the dispensing chamber of a washing machine. This has the advantage that no additional rinse cycle is necessary and no unpleasant deposits occur in the dispensing chamber.

Furthermore, a solid melt body of this kind may be used in the wash cycle of a laundry cleaning process and thus may transport the textile care compound and the perfume to the laundry right at the beginning of the washing process in order to develop their full potential. Furthermore, said melt body is easier and better to handle than liquid compositions since, during subsequent storage of the bottle, no drops are left on the edge of the bottle that run down to the edges on the ground or result in unpleasant deposits in the region of the bottle cap. The same applies to the case in which, during dosing, some of the melt body is accidentally spilled. The spilled amount can also be removed more easily and cleanly.

A polysiloxane that can preferably be used has at least the following structural unit a)

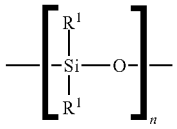

where $R^1$=independently of one another $C_1$-$C_{30}$ alkyl, preferably $C_1$-$C_4$ alkyl, in particular methyl or ethyl, n=1 to 5,000, preferably 10 to 2,500, in particular 100 to 1,500.

It may be preferable for the polysiloxane to additionally have the following structural unit:

b)

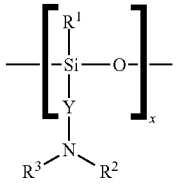

where $R^1$=$C_1$-$C_{30}$ alkyl, preferably $C_1$-$C_4$ alkyl, in particular methyl or ethyl, Y=optionally substituted, linear or branched $C_1$-$C_{20}$ alkylene, preferably —$(CH_2)_m$—, where m=1 to 16, preferably 1 to 8, in particular 2 to 4, especially 3, $R^2$, $R^3$=independently of one another, H or optionally substituted, linear or branched $C_1$-$C_{30}$ alkyl, preferably comprising $C_1$-$C_{30}$ alkyl substituted with amino groups, particularly preferably —$(CH_2)_b$—$NH_2$ where b=1 to 10, most preferably b=2, x=1 to 5,000, preferably 10 to 2,500, in particular 100 to 1,500.

If the polysiloxane has only the structural unit a) where $R^1$=methyl, it is a polydimethylsiloxane. Polydimethylpolysiloxanes are known as efficient textile care compounds.

Suitable polydimethylsiloxanes include DC-200 (ex Dow Corning), Baysilone® M 50, Baysilone® M 100, Baysilone® M 350, Baysilone® M 500, Baysilone® M 1000, Baysilone® M 1500, Baysilone® M 2000 or Baysilone® M 5000 (all ex GE Bayer Silicones).

However, it may also be preferable for the polysiloxane to contain the structural units a) and b). A particularly preferred polysiloxane has the following structure:

$$(CH_3)_3Si—[O—Si(CH_3)_2]_n—[O—Si(CH_3)\{(CH_2)_3—NH—(CH_2)_2—NH_2\}]_x—OSi(CH_3)_3$$

where the sum n+x is a number between 2 and 10,000.

Suitable polysiloxanes having the structural units a) and b) are commercially available, for example, under the brand names DC2-8663, DC2-8035, DC2-8203, DC05-7022 or DC2-8566 (all ex Dow Corning). Also suitable according to the invention are, for example, the commercially available products Dow Corning® 7224, Dow Corning® 929 Cationic Emulsion or Formasil 410 (GE Silicones).

A suitable textile-softening clay is, for example, a smectite clay. Preferred smectite clays are beidellite clays, hectorite clays, laponite clays, montmorillonite clays, nontronite clays, saponite clays, sauconite clays, and mixtures thereof. Montmorillonite clays are the preferred softening clays. Bentonites contain primarily montmorillonites and may be used as a preferred source for the textile-softening clay. The bentonites may be used as powder or crystals.

Suitable bentonites are sold, for example, under the names Laundrosil® by Sal-Chemie or under the name Detercal by Laviosa. It is preferable for the textile care composition to contain a powdered bentonite as a textile care compound.

Suitable cationic polymers include, in particular, those described in "CTFA International Cosmetic Ingredient Dictionary," fourth edition, J. M. Nikitakis, et al., Editors, published by the Cosmetic, Toiletry, and Fragrance Association, 1991, and collectively referred to as "polyquaternium." In the following, some suitable polyquaternium compounds are listed in more detail.

POLYQUATERNIUM-1 (CAS number: 68518-54-7)

Definition: $\{(HOCH_2CH_2)_3N^+—CH_2CH=CHCH_2—[N^+(CH_3)_2—CH_2CH=CHCH_2]_x—N^+(CH_2CH_2OH)_3\}[Cl^-]_{x+2}$ POLYQUATERNIUM-2 (CAS number: 63451-27-4)

Definition: $[—N(CH_3)_2—CH_2CH_2CH_2—NH—C(O)—NH—CH_2CH_2CH_2—N(CH_3)_2—CH_2CH_2OCH_2CH_2—]^{2+}(Cl^-)_2$

POLYQUATERNIUM-3

Definition: copolymer of acrylamide and trimethylammoniumethyl methacrylate methosulfate POLYQUATERNIUM-4 (CAS number: 92183-41-0)

Definition: copolymer of hydroxyethylcellulose and diallyldimethylammonium chloride. Available for example as Celquat® H 100 or Celquat® L200 (ex National Starch)

POLYQUATERNIUM-5 (CAS number: 26006-22-4)

Definition: copolymer of acrylamide and β-methacrylyloxyethyltrimethylammoniummethosulfate.

POLYQUATERNIUM-6 (CAS number: 26062-79-3)

Definition: Polymer of dimethyldiallylammonium chloride

POLYQUATERNIUM-7 (CAS number: 26590-05-6)

Definition: polymeric quaternary ammonium salt consisting of acrylamide and dimethyldiallylammonium chloride monomers.

POLYQUATERNIUM-8

Definition: polymeric quaternary ammonium salt of methyl and stearyldimethylaminoethyl-methacrylate, which was quaternized with dimethyl sulfate

POLYQUATERNIUM-9

Definition: polymeric quaternary ammonium salt of polydimethylaminoethyl methacrylate, which was quaternized with methyl bromide POLYQUATERNIUM-10 (CAS number: 68610-92-4)

Definition: quaternized hydroxyethyl cellulose

POLYQUATERNIUM-11 (CAS number: 53633-54-8)

Definition: quaternary ammonium polymer formed by reacting diethyl sulfate with the copolymer of vinylpyrrolidone and dimethyl aminoethyl methacrylate.

POLYQUATERNIUM-12 (CAS number: 68877-50-9)

Definition: quaternary ammonium polymer salt, obtainable by reacting the ethyl methacrylate/abietyl methacrylate/diethylaminoethyl methacrylate copolymer with dimethyl sulfate POLYQUATERNIUM-13 (CAS number: 68877-47-4)

Definition: polymeric quaternary ammonium salt, obtainable by reacting the ethyl methacrylate/oleyl methacrylate/diethylaminoethyl methacrylate copolymer with dimethyl sulfate POLYQUATERNIUM-14 (CAS number: 27103-90-8)

Definition: polymeric quaternary ammonium salt of formula $\{—CH_2—C—(CH_3)—[C(O)O—CH_2CH_2—N(CH_3)_3—]\}_x^+[CH_3SO_4]_x^-$ POLYQUATERNIUM-15 (CAS number: 35429-19-7)

Definition: copolymer of acrylamide and β-methacrylyloxyethyltrimethylammonium chloride POLYQUATERNIUM-16 (CAS number: 95144-24-4)

Definition: polymeric quaternary ammonium salt formed from methylvinylimidazolium chloride and vinylpyrrolidone POLYQUATERNIUM-17 (CAS number: 90624-75-2)

Definition: polymeric quaternary ammonium salt, obtainable by reacting adipic acid and dimethylaminopropylamine with dichloroethyl ether.

POLYQUATERNIUM-18

Definition: polymeric quaternary ammonium salt, obtainable by reacting azelaic acid and dimethylaminopropylamine with dichloroethyl ether.

POLYQUATERNIUM-19

Definition: polymeric quaternary ammonium salt, obtainable by reacting polyvinyl alcohol with 2,3-epoxypropylamine.

POLYQUATERNIUM-20

Definition: polymeric quaternary ammonium salt, obtainable by reacting polyvinyl octadecyl ether with 2,3-epoxypropylamine.

POLYQUATERNIUM-21 (CAS number: 102523-94-4)

Definition: polysiloxane/polydimethyldialkylammoniumacetate copolymer

POLYQUATERNIUM-22 (CAS number: 53694-17-0)

Definition: dimethyldiallylammonium chloride/acrylic acid copolymer

POLYQUATERNIUM-24 (CAS number: 107987-23-5)

Definition: polymeric quaternary ammonium salt from the reaction of hydroxyethylcellulose with a lauryldimethylammonium-substituted epoxide

POLYQUATERNIUM-27

Definition: block copolymer from the reaction of polyquaternium-2 with polyquaternium-17.

POLYQUATERNIUM-28 (CAS number: 131954-48-8)

Definition: vinylpyrrolidone/methacrylamidopropyltrimethylammonium chloride copolymer

POLYQUATERNIUM-29

Definition: chitosan, which was reacted with propylene oxide and quaternized with epichlorohydrin

POLYQUATERNIUM-30

Definition: polymeric quaternary ammonium salt of formula: $-[CH_2C(CH_3)(C(O)OCH_3)]—[CH_2C(CH_3)(C(O)OCH_2CH_2N^+(CH_3)_2CH_2COO^-)]_y-$ POLYQUATERNIUM-31 (CAS number: 136505-02-7)

POLYQUATERNIUM-32 (CAS number: 35429-19-7)

Definition: polymer of N,N,N-trimethyl-2-[(2-methyl-1-oxo-2-propenyl)oxy]-ethanaminium chloride with 2-propenamide POLYQUATERNIUM-37 (CAS number: 26161-33-1)

Definition: homopolymer of methacryloyltrimethylchloride. Available for example as Synthalen® CR (ex 3V Sigma)

POLYQUATERNIUM-44 (CAS number: 150595-70-5)

Definition: quaternary ammonium salt of the copolymer of vinylpyrrolidone and quaternized imidazoline POLYQUATERNIUM-68 (CAS number: 827346-45-2)

Definition: quaternized copolymer of vinylpyrrolidone, methacrylamide, vinylimidazole and quaternized vinylimidazole It may be preferable for the melt bodies to contain a textile-softening compound and one or more other textile care compound(s).

The amount of textile care compound in the melt body may, in various embodiments, be 0.1 to 15 wt. %, and preferably 2 to 12 wt. %.

The melt bodies may optionally contain further ingredients. In order to improve the practical and/or aesthetic properties, irrespective of intended use, these additional ingredients are preferably selected from the group consisting of dyes, fillers, polysaccharides, pearlescing agents, skin care compounds, bitter substances and mixtures thereof.

The melt bodies may be dyed using suitable dyes in order to improve their appearance. Preferred dyes, which can be selected by a person skilled in the art without any difficulty at all, should be highly stable in storage, unaffected by the other ingredients of the washing or cleaning agent, insensitive to light and should not exhibit pronounced substantivity with respect to textile fibers in order to avoid dyeing said fibers.

Furthermore, the melt bodies may contain a filler, such as silica or inorganic salts, for example sodium sulfate. The amount of filler may be between 0 and 30 wt. %, and preferably from 1 to 30 wt. %.

Suitable polysaccharides include, for example, starch. The amount may also be between 0 and 30 wt. %, and preferably from 1 to 30 wt. %.

The melt bodies may also contain a pearlescing agent to increase the shine.

Examples of suitable pearlescing agents are ethylene glycol mono- and distearate and PEG-3 distearate.

Furthermore, the melt bodies may comprise a skin care compound.

A skin care compound is understood to mean a compound or a mixture of compounds which, upon contact of a textile with the washing agent, are absorbed by the textile and, upon contact of the textile with the skin, are beneficial to the skin in comparison with a textile which has not been treated with the composition according to the invention. This benefit may include, for example, the transfer of the skin care compound from the textile to the skin, less water transfer from the skin to the textile, or less friction on the skin surface due to the textile.

The skin care compound is preferably hydrophobic, may be liquid or solid, and must be compatible with the other ingredients of the solid, textile care composition. The skin care compound may comprise, for example:

(a) waxes such as carnauba, spermaceti, beeswax, lanolin, derivatives thereof and mixtures thereof;

(b) plant extracts, for example vegetable oils such as avocado oil, olive oil, palm oil, palm kernel oil, rapeseed oil, linseed oil, soybean oil, peanut oil, coriander oil, castor oil, poppy seed oil, cocoa oil, coconut oil, pumpkin seed oil, wheat germ oil, sesame oil, sunflower oil, almond oil, macadamia nut oil, apricot kernel oil, hazelnut oil, jojoba oil or canola oil, chamomile, aloe vera and mixtures thereof;

(c) higher fatty acids such as lauric acid, myristic acid, palmitic acid, stearic acid, behenic acid, oleic acid, linoleic acid, linolenic acid, isostearic acid or polyunsaturated fatty acids;

(d) higher fatty alcohols such as lauryl alcohol, cetyl alcohol, stearyl alcohol, oleyl alcohol, behenyl alcohol or 2-hexadecanol;

(e) esters such as cetyloctanoate, lauryl lactate, myristyl lactate, cetyl lactate, isopropyl myristate, myristyl myristate, isopropyl palmitate, isopropyl adipate, butyl stearate, decyl oleate, cholesterol stearate, glycerol monostearate, glyceryl distearate, glycerol tristearate, alkyl lactate, alkyl citrate or alkyl tartrate;

(f) hydrocarbons such as paraffins, mineral oils, squalane or squalene;

(g) lipids;

(h) vitamins such as vitamin A, C or E or vitamin alkyl esters;

(i) phospholipids;

(j) sunscreens such as octyl methoxyl cinnamate and butyl methoxybenzoylmethane;

(k) silicone oils such as linear or cyclic polydimethylsiloxanes, amino-, alkyl-, alkylaryl- or aryl-substituted silicone oils; and (l) mixtures thereof.

The amount of skin care compound is preferably between 0.01 and 10 wt. %, more preferably between 0.1 and 5 wt. % and very particularly preferably between 0.3 and 3 wt. %, based on the total weight of the melt body. It may be the case that the skin care compound additionally has a textile care effect.

To prevent oral ingestion of the melt body composition by humans, in particular children, or animals, it may contain a bitter substance such as Bitrex®.

Exemplary formulations of suitable melt bodies comprise the following ingredients:

0.01 to 20 wt. %, in particular 0.1 to 20 wt. %, perfume oil and/or fragrance capsules 0.00 to 5 wt. % bentonite 0.00 to <1 wt. % dye(s)

0.00 to 30 wt. %, preferably 1 to 30 wt. %, of an inorganic salt, in particular sodium sulfate 0.00 to 30 wt. %, preferably 1 to 30 wt. %, of a polysaccharide, in particular starch,ad 100 wt. % polyethylene glycol having 4,000 to 15,000 g/mol, preferably 9,000 to 12,000 g/mol.

The melt bodies prepared by the methods described herein can be of any shape. Shaping takes place in particular in step (d) of the described method. Solid, particulate forms, such as substantially spherical, figurative, scaled, cuboid, cylindrical, conical or acicular particles are preferred. For example, the particles may have a gummy bear-like, figurative design. In this case, the maximum extent of the particles is in a spatial dimension of preferably from 0.5 to 10 mm, in particular from 0.8 to 7 mm, and particularly preferably from 1 to 3 mm. This means that, for example in the case of spherical particles, the average diameter of the particles is from 0.5 to 10 mm, in particular from 0.8 to 7 mm, and particularly preferably from 1 to 3 mm. Usually, the weight of the individual particles is between 2 and 150 mg, preferably between 5 and 10 mg.

In various embodiments, producing a melt, i.e. the melting, takes place in step (a) of the methods described herein by heating to a temperature that is not more than 20° C. above the melting point of the carrier polymer. Melting can be carried out using any conventional methods and devices known to a person skilled in the art. The melt containing the at least one carrier polymer is produced, for example continuously, by the at least one carrier polymer and optionally further components of the melt body being continuously supplied to an appropriate device in which it is heated and the melt thus produced is further conveyed, for example pumped. However, the melt can also be prepared separately, for example in a batch process. According to the invention, embodiments are also included in which the components of the melt are mixed together at any time prior to carrying out the method according to the invention and the mixture is stored in molten or cooled solid form until the method is carried out.

In a next step, the at least one fragrance is then fed continuously to the melt. For this purpose, the at least one fragrance is preferably used in liquid form, for example as a perfume oil, as a solution in a suitable solvent or as a suspension of perfume capsules in a, typically water-containing, solvent. "Liquid" as used in this context means liquid under the conditions of use, preferably liquid at 20° C.

During preparation, the flow can optionally be controlled by means of flow rate measurement of the individual dosed flows, i.e. the melt, the fragrance flow and optionally further ingredient flows. This also allows, for example, for the proportions of the individual components to be adjusted. The ingredients, in addition to the carrier polymer(s) and the fragrances, can be produced directly together with the carrier polymer as a melt, be fed in together with the fragrances or be fed in separately to the melt. In the latter alternative, the feeding in may take place before or after the feeding in of the fragrances.

In some embodiments, the method according to the invention is characterized in that the at least one textile care compound and/or the additional ingredients (A) are fed to the melt which has been conveyed in step (a), optionally produced and conveyed, and/or (B) are obtained in the melt conveyed in step (a), optionally produced and conveyed. The method according to the invention can be characterized in that the at least one textile care compound and/or the additional ingredients (A) are fed to the melt which has been conveyed in step (a), optionally produced and conveyed, and/or (B) are obtained in the melt conveyed in step (a), optionally produced and conveyed.

The mixing of the combined dosed flows can then be carried out, in each case directly after feeding in or downstream after feeding in several or all of the ingredients, using suitable mixers such as conventional static or dynamic mixing units.

After mixing, the melt containing the fragrances and optionally other ingredients and the carrier polymer is cooled and optionally supplied to the shaping step in which the melt solidifies and obtains its final shape. Suitable methods for shaping are known to a person skilled in the art. Conventional forms have already been described above.

The invention also relates to the melt bodies obtained by means of the methods described herein and to the use thereof as textile care agents, preferably fragrancing agents and/or softeners, for fragrancing and/or conditioning textile fabrics. The melt bodies may be a textile treatment agent such as a fabric softener or a part of an agent of this kind.

Furthermore, the invention relates to a washing or cleaning agent comprising the melt bodies prepared according to the invention.

By introducing the perfume-containing melt body prepared according to the invention into a washing or cleaning agent, the consumer is provided with a textile care washing or cleaning agent (a "2-in-1" washing or cleaning agent) and does not need to dose two agents or require a separate rinse cycle. Since the compositions prepared according to the invention are perfumed, the washing or cleaning agent does not need to be perfumed as well. Not only does this result in lower costs, it is also advantageous for consumers with sensitive skin and/or allergies.

The melt body compositions described herein are particularly suitable for conditioning textile fabrics and are, for this purpose, together with a conventional washing or cleaning agent, brought into contact with the textile fabrics in the (main) wash cycle of a conventional washing and cleaning process.

If the melt body composition according to the invention is part of a washing or cleaning agent, a solid washing or cleaning agent may preferably be mixed with 1 to 20 wt. %, in particular 5 to 15 wt. %, of the composition according to the invention.

The preferred embodiments described in connection with the methods according to the invention can likewise be transferred to the melt bodies as such, to the washing and cleaning agents containing said bodies and to the uses described herein, and vice versa.

What is claimed is:

1. A continuous method for the preparation of perfume-containing melt bodies comprising at least one water-soluble or water-dispersible carrier polymer having a melting point of >30° C. to 250° C., selected from polyalkylene glycols, at least one fragrance and a pro-fragrance, and at least one textile care compound selected from textile-softening compounds, silicone oils, anti-redeposition agents, optical brighteners, graying inhibitors, shrinkage preventers, anti-crease agents, dye transfer inhibitors, antimicrobial active ingredients, germicides, fungicides, antioxidants, antistatic agents, ironing aids, repellants, impregnating agents, anti-swelling and anti-slip agents, UV absorbers and mixtures thereof, wherein the textile-softening compound is selected from the group of polysiloxanes, textile-softening clays, cationic polymers, and mixtures thereof, characterized in that the method comprises the steps of:

(a) continuously conveying, optionally continuously producing and conveying, a melt comprising the at least one water-soluble or water-dispersible carrier polymer;

(b) continuously feeding the at least one fragrance to the melt comprising the at least one water-soluble or water-dispersible carrier polymer;

(c) mixing the melt comprising the at least one water-soluble or water-dispersible carrier polymer and the at least one fragrance; and (d) cooling and optionally shaping the mixture to obtain perfume-containing melt bodies.

2. The method according to claim 1, characterized in that the at least one fragrance (A) is contained in the composition in an amount of from 0.1 to 20 wt. %; and/or (B) is used in the form of fragrance capsules and/or perfume oils.

3. The method according to claim 1, characterized in that the at least one textile care compound and/or the additional ingredients (A) are fed to the melt which has been conveyed in step (a), optionally produced and conveyed, and/or (B) are obtained in the melt conveyed in step (a), optionally produced and conveyed.

4. The method according to claim 1, characterized in that the flow of the melt and/or of the at least one fragrance is controlled by means of flow rate measurement of the dosed flows.

5. The method according to claim 1, characterized in that the mixing in step (c) is carried out using a static or dynamic mixer.

6. The method according to claim 1, characterized in that the melting point of the at least one water-soluble or water-dispersible carrier polymer is 40° C. to 150° C.

7. The method according to claim 1, characterized in that the water-soluble carrier polymer (A) has a melting point of from 48° C. to 120° C.; and/or (B) is contained in the melt bodies in an amount of from 30 to 95 wt. %, based on the total weight of said bodies; and/or (C) is a polyethylene glycol having an average molecular weight of >1,500 g/mol and a melting point in the range from 45 to 70° C.

8. The method according to claim 7, characterized in that the melting point of the water-soluble carrier polymer is from 48° C. to 80° C.

9. The method according to claim 7, characterized in that the water-soluble carrier polymer is a polyethylene glycol having an average molecular weight of between 3,000 and 15,000.

10. The method according to claim 7, characterized in that the water-soluble carrier polymer is a polyethylene glycol having an average molecular weight of between 4,000 and 13,000.

11. The method according to claim 7, characterized in that the water-soluble carrier polymer is a polyethylene glycol having an average molecular weight of between 9,000 and 12,000.

12. The method according to claim 7, characterized in that the water-soluble carrier polymer is a polyethylene glycol a melting point in the range from 50 to 65° C.

13. The method according to claim 1, characterized in that the at least one textile care compound includes the textile-softening compound.

14. The method according to claim 13, wherein the textile-softening compound includes the polysiloxanes.

15. The method accordingly to claim 13, wherein the textile-softening compound includes the cationic polymers.

16. The method according to claim 1, characterized in that the melt body contains additional ingredients.

17. The method according to claim 16, characterized in that the additional ingredients of the melt body are selected from the group consisting of dyes, fillers, polysaccharides, pearlescing agents, skin care compounds, bitter substances and mixtures thereof.

18. The method according to claim 17, wherein the melt body includes the fillers in an amount of from 1 to 30 wt. % based on the total weight of the melt body.

19. The method according to claim 17, wherein the melt body includes the polysaccharides in an amount of from 1 to 30 wt. % based on the total weight of the melt body.

20. A perfume-containing melt body which can be obtained by means of the continuous production method according to claim 1.

* * * * *